United States Patent [19]

Yamada et al.

[11] Patent Number: 4,601,749

[45] Date of Patent: Jul. 22, 1986

[54] METHOD FOR ADJUSTING CHEMICAL COMPOSITION OF MOLTEN PIG IRON TAPPED FROM BLAST FURNACE

[75] Inventors: Kenzo Yamada; Katsuhiro Iwasaki, both of Fukuyama; Mitsuru Ohtsuki, Tokyo; Haruo Ito, Fukuyama, all of Japan

[73] Assignee: Nippon Kokan Kabushiki Kaisha, Tokyo, Japan

[21] Appl. No.: 776,968

[22] PCT Filed: Feb. 4, 1985

[86] PCT No.: PCT/JP85/00045

§ 371 Date: Sep. 4, 1985

§ 102(e) Date: Sep. 4, 1985

[87] PCT Pub. No.: WO85/03524

PCT Pub. Date: Aug. 15, 1985

[30] Foreign Application Priority Data

Feb. 4, 1984 [JP] Japan ..... 59-19183

[51] Int. Cl.[4] ..... C21C 7/02

[52] U.S. Cl. ..... 75/53; 75/51.6; 75/58; 75/59.13

[58] Field of Search ..... 75/53, 58, 51.6, 59.13

[56] References Cited

U.S. PATENT DOCUMENTS 4,197,116 4/1980 Kolb ..... 75/51.6

4,392,887 7/1983 Goedert ..... 75/58

*Primary Examiner*—Peter D. Rosenberg

*Attorney, Agent, or Firm*—Frishauf, Holtz, Goodman & Woodward

[57] ABSTRACT

At least one lance is substantially vertically arranged above a hot-metal runner of a blast furnace so that the lowermost end of the lance is spaced apart by a prescribed distance from the surface of molten pig iron flowing through the hot-metal runner. A granular chemical composition adjusting agent for adjusting the chemical composition of molten pig iron is blown, through the lance, into molten pig iron by means of a carrier gas to adjust the chemical composition of molten pig iron so as to satisfy the following two equations:

$$0.5H \leqq H_p < H \quad (1)$$

$$H_p = M \cdot G \cdot \exp(-r)/(D + 0.02H_L)^2 \quad (2)$$

In equations (1) and (2):

H: depth of molten pig iron in the hot-metal runner (mm), $H_p$: penetration depth of the granular chemical composition adjusting agent into molten pig iron in the hot-metal runner (mm), M: flow rate of the granular chemical composition adjusting agent (kg/minute), G: flow rate of the carrier gas ($Nm^3$/minute), $\bar{r}$: average particle size of the granular chemical composition adjusting agent (mm), D: inside diameter of the lance (mm), and $H_L$: distance between the surface of molten pig iron in the hot-metal runner and the lowermost end of the lance (mm).

12 Claims, 6 Drawing Figures

METHOD FOR ADJUSTING CHEMICAL COMPOSITION OF MOLTEN PIG IRON TAPPED FROM BLAST FURNACE

FIELD OF THE INVENTION

The present invention relates to a method for adjusting the chemical composition of molten pig iron in the middle of a hot-metal runner for directing molten pig iron tapped from a blast furnace into a hot-metal ladle.

BACKGROUND OF THE INVENTION

There are known methods for adjusting the chemical composition of molten pig iron by removing at least one of such impurities as silicon, phosphorus and sulfur contained in molten pig iron in the middle of a hot-metal runner for directing molten pig iron tapped from a blast furnace into a hot-metal ladle.

The above-mentioned conventional method commonly applied so far for adjusting the chemical composition of molten pig iron by removing impurities contained in molten pig iron in the middle of the hot-metal runner, comprises charging a granular chemical composition adjusting agent for removing impurities contained in molten pig iron from a hopper arranged above the hot-metal runner into molten pig iron flowing through the hot-metal runner.

This method has however the disadvantage of a low removing efficiency of impurities because of the insufficient contact between molten pig iron and the granular chemical composition adjusting agent as a result of the fact that the charged granular chemical composition adjusting agent floats on the surface of molten pig iron and does not sufficiently penetrate into molten pig iron.

As a method for adjusting the chemical composition of molten pig iron, which solves the above-mentioned disadvantage through achievement of a sufficient contact between molten pig iron and the granular chemical composition adjusting agent and thus efficiently removes impurities contained in molten pig iron, there is known a method, disclosed in Japanese Patent Provisional Publication No. 57-200,510 dated Dec. 8, 1982, for adjusting the chemical composition of molten pig iron, which comprises:

substantially vertically arranging a lance above a hot-metal runner for directing molten pig iron tapped from a blast furnace into a hot-metal ladle so that the lower end portion of said lance is immersed into molten pig iron flowing through said hot-metal runner; and blowing, through said lance, a granular chemical composition adjusting agent for removing silicon as one of impurities contained in molten pig iron by means of a carrier gas, into molten pig iron flowing through said hot-metal runner (hereinafter referred to as the "prior art 1").

The above-mentioned prior art 1 involves the following drawbacks:

(1) The lower end portion of the lance, being immersed into molten pig iron, is susceptible to serious fusion. It is therefore necessary to frequently replace the lance, thus requiring much costs.

(2) Since the lower end portion of the lance is immersed into molten pig iron and the granular chemical composition adjusting agent is vigorously blown into molten pig iron through the lance, the blown granular chemical composition adjusting agent seriously hits the bottom of the hot-metal runner, thus the bottom of the hot-metal runner being mechanically and chemically damaged. It is therefore necessary to frequently repair the bottom of the hot-metal runner, thus requiring much costs.

As a method for adjusting the chemical composition of molten pig iron, which solves the above-mentioned drawbacks involved in the prior art 1 and permits efficient removal of impurities from molten pig iron without the risk of causing fusion of the lower end portion of the lance or damage to the bottom of the hot-metal runner, there is known a method, disclosed in Japanese Patent Provisional Publication No. 58-130,208 dated Aug. 3, 1983, for adjusting the chemical composition of molten pig iron, which comprises:

substantially vertically arranging at least one lance above a hot-metal runner for directing molten pig iron tapped from a blast furnace into a hot-metal ladle so that the lowermost end of said at least one lance is spaced apart by a prescribed distance from the surface of molten pig iron flowing through said hot-metal runner; and blowing, through said at least one lance, a granular chemical composition adjusting agent for removing impurities contained in molten pig iron by means of a carrier gas, into molten pig iron flowing through said hot-metal runner (hereinafter referred to as the "prior art 2").

According to the above-mentioned prior art 2, the lower end portion of the lance, not being immersed into molten pig iron, becomes free from fusion. In addition, because of the prescribed distance between the surface of molten pig iron and the lowermost end of the lance, damage to the bottom of the hot-metal runner caused by blowing of the granular chemical composition adjusting agent is reduced.

The above-mentioned prior art 2 has however the following drawbacks:

(1) Since the granular chemical composition adjusting agent is blown into molten pig iron without controlling the penetration depth thereof into molten pig iron, impurities cannot be removed from molten pig iron at a stable and high efficiency.

(2) Since the granular chemical composition adjusting agent is blown into molten pig iron without controlling the penetration depth thereof into molten pig iron, there is still a possibility of considerable damage to the bottom of the hot-metal runner.

The above-mentioned drawbacks are caused also when a granular chemical composition adjusting agent for further increasing the carbon content in molten pig iron is blown into molten pig iron tapped from a blast furnace to increase the carbon content in molten pig iron.

Under such circumstances, when substantially vertically arranging at least one lance above a hot-metal runner for directing molten pig iron tapped from a blast furnace into a hot-metal ladle so that the lowermost end of said at least one lance is spaced apart by a prescribed distance from the surface of molten pig iron flowing through said hot-metal runner, and blowing, through said at least one lance, a granular chemical composition adjusting agent for removing impurities contained in molten pig iron, or a granular chemical composition adjusting agent for further increasing the carbon content in molten pig iron by means of a carrier gas, into molten pig iron flowing through said hot-metal runner, to remove impurities contained in molten pig iron or to increase the carbon content in molten pig iron, thus adjusting the chemical composition of molten pig iron, there is a strong demand for the development of a method adaptable to actual operations for adjusting the chemical composition of molten pig iron tapped from a blast furnace, which permits adjustment of the chemical composition of molten pig iron at a stable and high efficiency without the risk of damage to the bottom of the hot-metal runner caused by blowing of the granular chemical composition adjusting agent. However, such a method for adjusting the chemical composition of molten pig iron has not as yet been proposed.

SUMMARY OF THE INVENTION

An object of the present invention is, therefore, when substantially vertically arranging at least one lance above a hot-metal runner for directing molten pig iron, tapped from a blast furnace into a hot-metal ladle, so that the lowermost end of said at least one lance is spaced apart by a prescribed distance from the surface of molten pig iron flowing through said hot-metal runner, and blowing, through said at least one lance, a granular chemical composition adjusting agent for removing impurities contained in molten pig iron, or a granular chemical composition adjusting agent for further increasing the carbon content in molten pig iron by means of a carrier gas, into molten pig iron flowing through said hot-metal runner, to remove impurities contained in molten pig iron or to increase the carbon content in molten pig iron, thus adjusting the chemical composition of molten pig iron, to provide a method adaptable to actual operations for adjusting the chemical composition of molten pig iron tapped from a blast furnace, which permits adjustment of the chemical composition of molten pig iron at a stable and high efficiency without the risk of damage to the bottom of the hot-metal runner caused by blowing of the granular chemical composition adjusting agent.

In accordance with one of the features of the present invention, there is provided a method for adjusting the chemical composition of molten pig iron tapped from a blast furnace, which comprises:

substantially vertically arranging at least one lance above a hot-metal runner for directing molten pig iron tapped from a blast furnace into a hot-metal ladle so that the lowermost end of said at least one lance is spaced apart by a prescribed distance from the surface of molten pig iron flowing through said hot-metal runner, and blowing, through said at least one lance, a granular chemical composition adjusting agent by means of a carrier gas into molten pig iron flowing through said hot-metal runner to adjust the chemical composition of said molten pig iron;

characterized in that:

said blowing of said granular chemical composition adjusting agent through said at least one lance into said molten pig iron is carried out so as to satisfy the following two equations:

$$0.5H \leqq Hp < H \quad (1)$$

$$Hp = M \cdot G \cdot exp(-\bar{r})/(D + 0.02H_L)^2 \quad (2)$$

in equations (1) and (2),

H: depth of molten pig iron in the hot-metal runner (mm),

Hp: penetration depth of the granular chemical composition adjusting agent into molten pig iron in the hot-metal runner (mm), M: flow rate of the granular chemical composition adjusting agent (kg/minute), G: flow rate of the carrier gas ($Nm^3$/minute), $\bar{r}$: average particle size of the granular chemical composition adjusting agent (mm), D: inside diameter of the lance (mm), and $H_L$: distance between the surface of molten pig iron in the hot-metal runner and the lowermost end of the lance (mm).

DETAILED DESCRIPTION OF PREFERRED EMBODIMENTS

From the above-mentioned point of view, when substantially vertically arranging at least one lance above a hot-metal runner for directing molten pig iron tapped from a blast furnace into a hot-metal ladle so that the lowermost end of said at least one lance is spaced apart by a prescribed distance from the surface of molten pig iron flowing through said hot-metal runner, and blowing, through said at least one lance, a granular chemical composition adjusting agent for removing impurities contained in molten pig iron, or a granular chemical composition adjusting agent for further increasing the carbon content in molten pig iron by means of a carrier gas, into molten pig iron flowing through said hot-metal runner, to remove impurities contained in molten pig iron or to increase the carbon content in molten pig iron, thus adjusting the chemical composition of molten pig iron, we carried out extensive studies to develop a method adaptable to actual operations for adjusting the chemical composition of molten pig iron tapped from a blast furnace, which permits adjustment of the chemical composition of molten pig iron at a stable and high efficiency without the risk of damage to the bottom of the hot-metal runner caused by blowing of the granular chemical composition adjusting agent.

Figure 1:
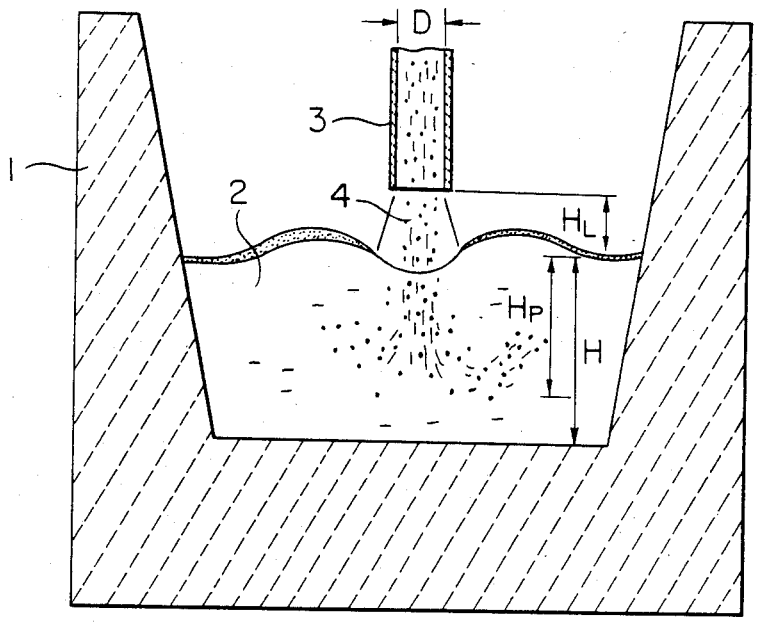
FIG. 1 is a schematic cross-sectional view illustrating blowing of a granular chemical composition adjusting agent into molten pig iron flowing through hot-metal runner by means of a carrier gas through a lance which is arranged substantially vertically above a hot-metal runner so that the lowermost end of the lance is spaced apart by a prescribed distance from the surface of molten pig iron flowing through the hot-metal runner.

As a result, we obtained the following finding:

As shown in FIG. 1, a granular chemical composition adjusting agent 4 for adjusting the chemical composition of molten pig iron was blown by means of a carrier gas into molten pig iron 2 flowing through a hot-metal runner 1 through a lance 3 arranged substantially vertically above the hot-metal runner 1 of a blast furnace so that the lowermost end of the lance 3 is spaced apart by a prescribed distance $H_L$ from the surface of molten pig iron 2 flowing through the hot-metal runner 1 to investigate the relationship between the ratio $H_P/H$ of the penetration depth $H_P$ of the granular chemical composition adjusting agent 4 into molten pig iron 2 in the hot-metal runner 1 to the depth H of molten pig iron 2 in the hot-metal runner 1, on the one hand, and the adjusting efficiency on the chemical composition of molten pig iron, on the other hand.

Values of the penetration depth $H_P$ of the granular chemical composition adjusting agent 4 blown through the lance 3 into molten pig iron 2 in the hot-metal runner 1 were determined in accordance with the following equation formulated by us:

$$H_P = M \cdot G \cdot \exp(-\bar{r})/(D+0.02H_L)^2$$

In the above equation, $H_P$: penetration depth of the granular chemical composition adjusting agent into molten pig iron in the hot-metal runner (mm), M: flow rate of the granular chemical composition adjusting agent (kg/minute), G: flow rate of the carrier gas ($Nm^3$/minute), $\bar{r}$: average particle size of the granular chemical composition adjusting agent (mm), D: inside diameter of the lance (mm), and $H_L$: distance between the surface of molten pig iron in the hot-metal runner and the lowermost end of the lance (mm).

The results obtained are shown in FIGS. 2 to 5.

Figure 2:
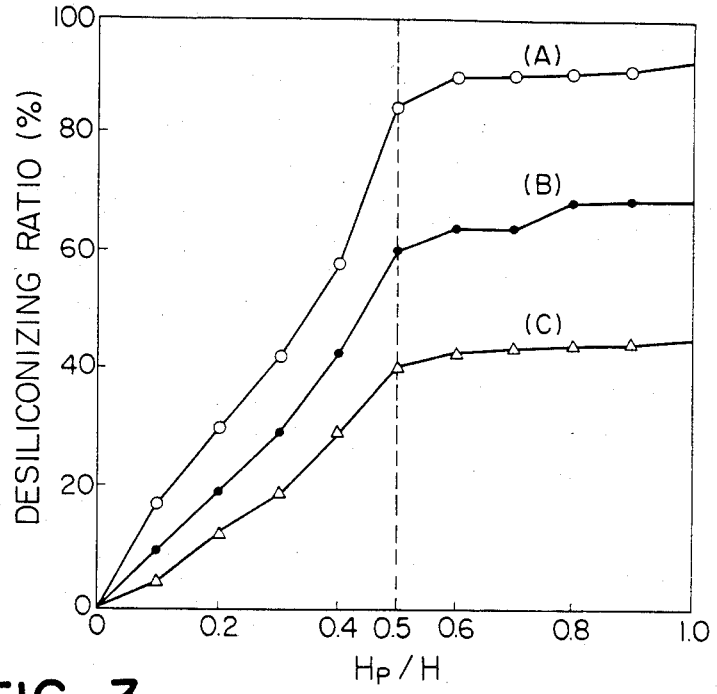
FIG. 2 is a graph illustrating the relationship between the ratio $H_P/H$ of the penetration depth $H_P$ of a granular chemical composition adjusting agent for removing silicon to the depth H of molten pig iron in the hot-metal runner, on the one hand, and the removing efficiency of silicon from molten pig iron, on the other hand.

FIG. 2 illustrates the results obtained in a case where mill scale was blown into molten pig iron as the granular chemical composition adjusting agent for removing silicon as one of impurities. In this case, molten pig iron had a flow rate of 7 tons/minute and a silicon content of 0.40 wt. % before removal of silicon. In FIG. 2, the consumption of the granular chemical composition adjusting agent was 40 kg/ton for (A), 30 kg/ton for (B), and 15 kg/ton for (C).

Figure 3:
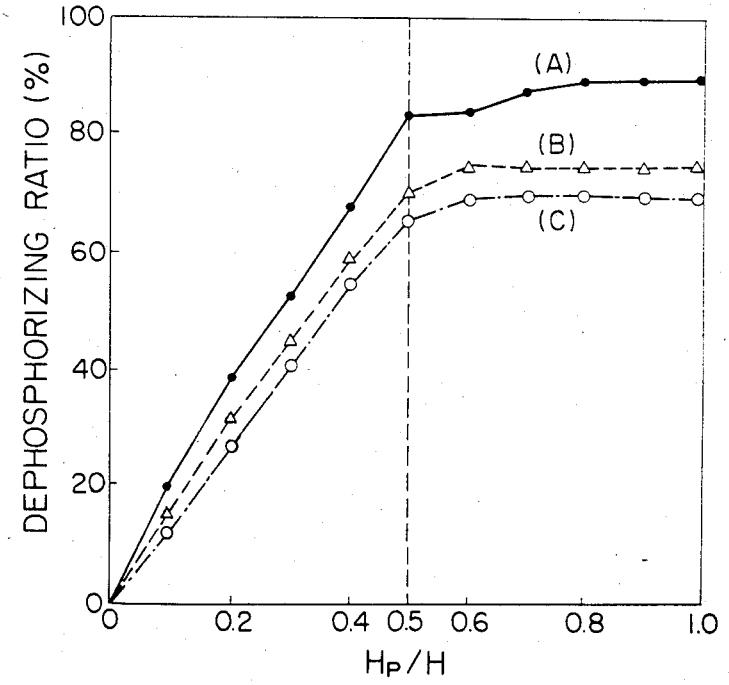
FIG. 3 is a graph illustrating the relationship between the ratio $H_P/H$ of the penetration depth $H_P$ of a granular chemical composition adjusting agent for removing phosphorus to the depth H of molten pig iron in the hot-metal runner, on the one hand, and the removing efficiency of phosphorus from molten pig iron, on the other hand.

FIG. 3 illustrates the results obtained in a case where a granular chemical composition adjusting agent for removing phosphorus as one of impurities was blown into molten pig iron having a low silicon content of under 0.05 wt. %. In this case, molten pig iron had a flow rate of 7 tons/minute, and a phosphorus content of 0.110 wt. % before removal of phosphorus. In FIG. 3, (A) represents the case with a mixture of mill scale and soda ash (mill scale: soda ash = 50 wt. %: 50 wt. %) used as the granular chemical composition adjusting agent, (B) represents the case with a mixture of mill scale, calcined lime and fluorite (mill scale: calcined lime: fluorite = 55 wt. %: 30 wt. %: 15 wt. %), and (C) represents the case with a mixture of mill scale, crushed converter slag and fluorite (mill scale: crushed converter slag: fluorite = 30 wt. %: 50 wt. %: 20 wt. %). In all the cases (A), (B) and (C), the consumption of the granular chemical composition adjusting agent was 40 kg/ton.

Figure 4:
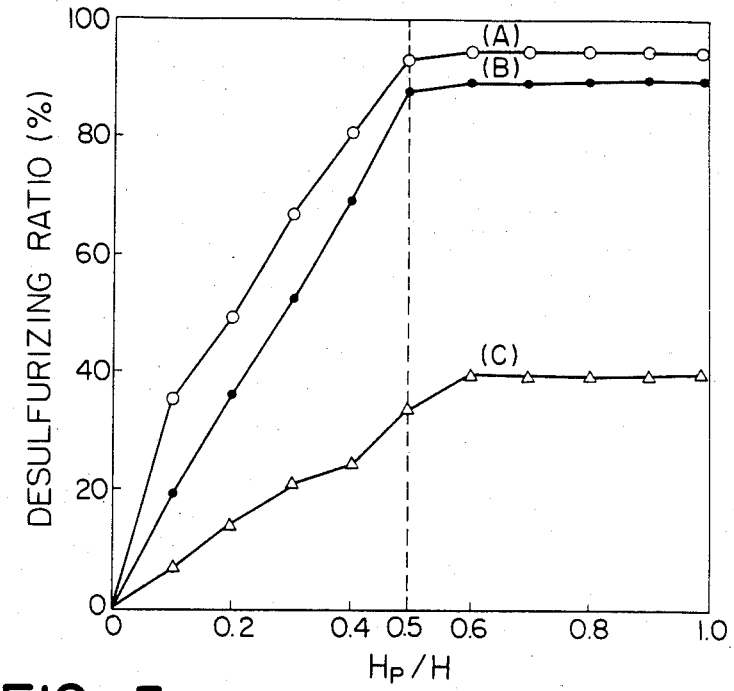
FIG. 4 is a graph illustrating the relationship between the ratio $H_R/H$ of the penetration depth $H_P$ of a granular chemical composition adjusting agent for removing sulfur to the depth H of molten pig iron in the hot-metal runner, on the one hand, and the removing efficiency of sulfur from molten pig iron, on the other hand.

FIG. 4 illustrates the results obtained in a case where a granular chemical composition adjusting agent for removing sulfur as one of impurities was blown into molten pig iron. In this case, molten pig iron had a flow rate of 7 tons/minute and a sulfur content of 0.40 wt. % before removal of sulfur. In FIG. 4, (A) represents the case with a mixture of mill scale and soda ash (mill scale: soda ash = 50 wt. %: 50 wt. %) used as the granular chemical composition adjusting agent, (B) represents the case with a mixture of mill scale, calcined lime and fluorite (mill scale: calcined lime: fluorite = 55 wt. %: 30 wt. %: 15 wt. %), and (C) represents the case with a mixture of calcined lime and fluorite (calcined lime: fluorite = 92 wt. %: 8 wt. %). The consumption of the granular chemical composition adjusting agent was 40 kg/ton for (A), 50 kg/ton for (B), and 10 kg/ton for (C).

Figure 5:
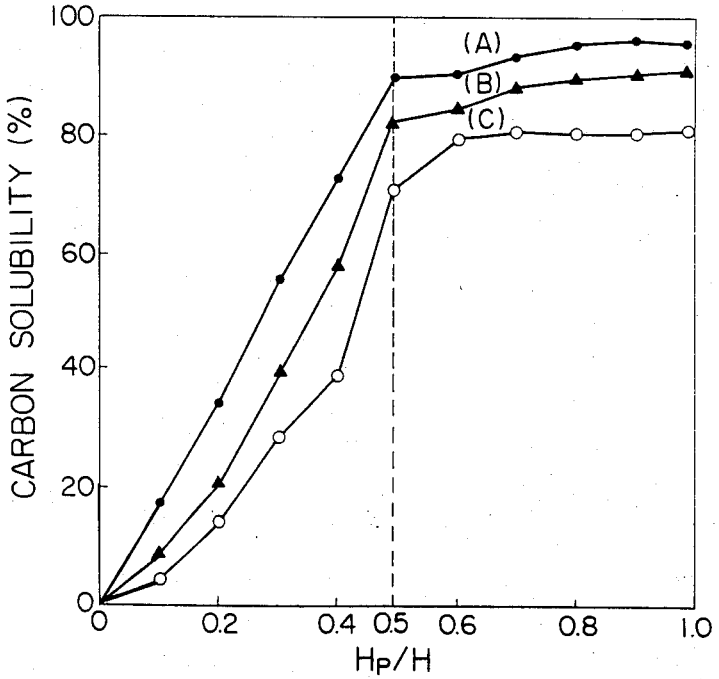
FIG. 5 is a graph illustrating the relationship between the ratio $H_P/H$ of the penetration depth $H_P$ of a granular chemical composition adjusting agent for further increasing the carbon content in molten pig iron to the depth H of molten pig iron in the hot-metal runner, on the one hand, and the solubility of carbon into molten pig iron, on the other hand.

FIG. 5 illustrates the results obtained in a case where a granular chemical composition adjusting agent for further increasing the carbon content in molten pig iron was blown into molten pig iron. In this case, molten pig iron had a flow rate of 7 tons/minute. In FIG. 5, (A) represents the case with ash-removed coal fine used as the granular chemical composition adjusting agent for further increasing the carbon content in molten pig iron, (B) represents the case with coke breeze, and (C) represents the case with coal fine. In all the cases (A), (B) and (C), the consumption of the granular chemical composition adjusting agent was 15 kg/ton. The carbon solubility (%) was calculated by the following equation:

Carbon solubility (%) = C solution/C total × 100 where, C total is the amount of carbon blown into molten pig iron, and C solution is the amount of carbon dissolved into molten pig iron from among the carbon blown.

As is clear from FIGS. 2 to 5, according as the ratio $H_P/H$ increases closer to 0.5, the desiliconizing ratio, dephosphorizing ratio, desulfurizing ratio and carbon solubility rapidly increase, and with the ratio $H_P/H$ of at least 0.5, these values show sufficiently high levels except for (B) and (C) in FIG. 2 and (C) in FIG. 4 in which the consumption of the granular chemical composition adjusting agent is small. Rise of the desiliconizing ratio and other values with a ratio $H_P/H$ of at least 0.5 is attributable to the fact that blowing of the granular chemical composition adjusting agent to a depth of at least a half the depth H of molten pig iron in the hot-metal runner causes satisfactory mixing of the granular chemical composition adjusting agent into molten pig iron to ensure sufficient contact with molten pig iron, and as a result, reaction between molten pig iron and the granular chemical composition adjusting agent proceeds rapidly.

It is therefore possible to adjust the chemical composition of molten pig iron at a stable and high efficiency without the risk of damage to the bottom of a hot-metal runner of a blast furnace caused by blowing of the granular chemical composition adjusting agent, by blowing the granular chemical composition adjusting agent into molten pig iron by means of a carrier gas through at least one lance substantially vertically arranged above the hot-metal runner so that the lowermost end of the lance is spaced apart by a prescribed distance from the surface of molten pig iron flowing through the hot-metal runner, so as to satisfy the following two equations:

$$0.5H \leqq H_P < H \quad (1)$$

$$H_P = M \cdot G \cdot exp(-\bar{r})/(D+0.02H_L)^2 \quad (2)$$

in equations (1) and (2),

H: depth of molten pig iron in the hot-metal runner (mm), $H_P$: penetration depth of the granular chemical composition adjusting agent into molten pig iron in the hot-metal runner (mm), M: flow rate of the granular chemical composition adjusting agent (kg/minute), G: flow rate of the carrier gas ($Nm^3$/minute), $\bar{r}$: average particle size of the granular chemical composition adjusting agent (mm), D: inside diameter of the lance (mm), and $H_L$: distance between the surface of molten pig iron in the hot-metal runner and the lowermost end of the lance (mm).

The present invention was made on the basis of the above-mentioned finding. Now, the method for adjusting the chemical composition of molten pig iron tapped from a blast furnace according to the present invention is described.

First, the parameters used in the above-mentioned equation (2) are described below.

The flow rate M of the granular chemical composition adjusting agent depends upon the flow rate of molten pig iron flowing through the hot-metal runner and the target adjusting efficiency of the chemical composition of molten pig iron which is to be attained through addition of the granular chemical composition adjusting agent. The flow rate M of the granular chemical composition adjusting agent is usually determined at a value within the range of from 100 to 500 kg/minute.

For the granular chemical composition adjusting agent, a smaller particle size is more favorable in terms of blowing into molten pig iron through a carrier gas, because the smaller particle size of the granular chemical composition adjusting agent causes the flow velocity thereof to be closer to that of the carrier gas, and this leads to a higher kinetic energy of the granular chemical composition adjusting agent. However, a smaller particle size of the granular chemical composition adjusting agent leads to an increased cost of crushing for the manufacture thereof. In view of the crushing cost, therefore, there should be an optimum range of particle sizes from the economic point of view. We are employing the chemical composition adjusting agent with a maximum particle size of 1 mm and an average particle size of 0.3 mm.

Basically, the flow rate G of the carrier gas has only to be such that the carrier gas carries the granular chemical composition adjusting agent to eject the latter from the lowermost end of the lance at a required flow rate M. However, when using a lance having a large inside diameter D, the ejecting velocity of the granular chemical composition adjusting agent at the lowermost end of the lance may become lower than 20 m/second, while ensuring the required flow rate M of the granular chemical composition adjusting agent by means of the carrier gas at the flow rate G. At an ejecting velocity of under 20 m/second, the granular chemical composition adjusting agent does not penetrate into molten pig iron at all as if it falls onto the surface of molten pig iron. To avoid the ejecting velocity of granular chemical composition adjusting agent becoming under 20 m/second, therefore, the flow rate G of the carrier gas may sometimes be increased beyond the value required for ensuring the sufficient flow rate M of the granular chemical composition adjusting agent.

The inside diameter D of the lance should be such that, under conditions including the flow rate M of the granular chemical composition adjusting agent and the flow rate G of the carrier gas, the ejecting velocity of the granular chemical composition adjusting agent at the lowermost end of the lance is at least 20 m/second. The distance $H_L$ between the lowermost end of the lance and the surface of molten pig iron in the hot-metal runner is a parameter that can be freely selected for the blowing operation of the granular chemical composition adjusting agent. The above-mentioned $H_L$ should be finally adjusted so that the penetration depth $H_P$ of the granular chemical composition adjusting agent, as determined by Equation (2) described above, is within the range of $0.5H \leqq H_P < H$ relative to the depth H of molten pig iron in the hot-metal runner. It is desirable to provide one lance for each blowing of the granular chemical composition adjusting agent from equipment considerations. However when it is necessary to use a high flow rate M of the granular chemical composition adjusting agent, two or more lances may be provided.

In the present invention, the granular chemical composition adjusting agent is blown into molten pig iron by means of the carrier gas through at least one lance, which is arranged substantially vertically above the hot-metal runner of the blast furnace so that the lowermost end of the lance is spaced apart by a prescribed distance from the surface of molten pig iron flowing through the hot-metal runner, so as to satisfy the above-mentioned equations (1) and (2), because it is possible to adjust the chemical composition of molten pig iron at a high efficiency without the risk of damage to the bottom of the hot-metal runner caused by blowing of the granular chemical composition adjusting agent when the granular chemical composition adjusting agent is blown to a penetration depth $H_P$ of at least a half the depth H of molten pig iron in the hot-metal runner but not reaching the bottom of the hot-metal runner. When, in contrast, equations (1) and (2) are not satisfied and the granular chemical composition adjusting agent is blown to a penetration depth $H_P$ of under a half the depth H of molten pig iron in the hot-metal runner, the chemical composition of molten pig iron cannot be adjusted at a high efficiency as desired.

When equations (1) and (2) are not satisfied and the granular chemical composition adjusting agent is blown to a penetration depth $H_P$ of over the depth of molten pig iron in the hot-metal runner, the chemical composition of molten pig iron can be adjusted at a high efficiency as desired, but damage is caused to the bottom of the hot-metal runner by blowing of the granular chemical composition adjusting agent.

In the present invention, a conventionally known granular chemical composition adjusting agent may be used for removing silicon as one of impurities contained in molten pig iron: for example, at least one selected from the group consisting of granular iron ore, granular ferromanganese ore, granular iron sand and granular mill scale.

In the present invention, a conventionally known granular chemical composition adjusting agent may be used for removing phosphorus as one of impurities contained in molten pig iron: for example, a mixture which comprises at least one selected from the group consisting of granular iron ore, granular ferro-manganese ore, granular iron sand and granular mill scale, on the one hand, and at least one selected from the group consisting of granular soda ash, granular calcined lime, granular limestone, granular converter slag and granular calcium carbide, on the other hand.

In the present invention, a conventionally known granular chemical composition adjusting agent may be used for removing sulfur as one of impurities contained in molten pig iron: for example, at least one selected from the group consisting of granular soda ash, granular calcined lime, granular limestone and granular calcium carbide.

In the present invention, a conventionally known granular chemical composition adjusting agent may be used for removing phosphorus and sulfur as impurities contained in molten pig iron: for example, a mixture which comprises at least one selected from the group consisting of granular iron ore, granular ferro-manganese ore, granular iron sand and granular mill scale, on the one hand, and at least one selected from the group consisting of granular soda ash, granular calcined lime, granular limestone, granular converter slag and granular calcium cabide, on the other hand.

In the present invention, a conventionally known granular chemical composition adjusting agent may be used for further increasing the carbon content in molten pig iron: for example, at least one selected from the group consisting of coal fine, coke breeze and ash-removed coal fine.

When removing phosphorus or sulfur as one of impurities contained in molten pig iron according to the method of the present invention, the presence of molten blast furnace slag, if any, on the surface of molten pig iron deteriorates the removing efficiency of the granular chemical composition adjusting agent for removing phosphorus or sulfur. Therefore, when blowing the granular chemical composition adjusting agent for removing phosphorus or sulfur, it is desirable to previously remove molten blast furnace slag. When removing silicon as one of impurities contained in molten pig iron, in contrast, it is not always necessary to previously remove molten blast furnace slag since the presence of molten blast furnace slag improves the removing efficiency of the granular chemical composition adjusting agent for removing silicon.

When removing phosphorus as one of impurities contained in molten pig iron, the granular chemical composition adjusting agent for removing phosphorus preferentially reacts with silicon, thus seriously reducing the phosphorus removing efficiency. It is therefore necessary, when blowing the granular chemical composition adjusting agent for removing phosphorus, to previously remove silicon from molten pig iron.

Figure 6:
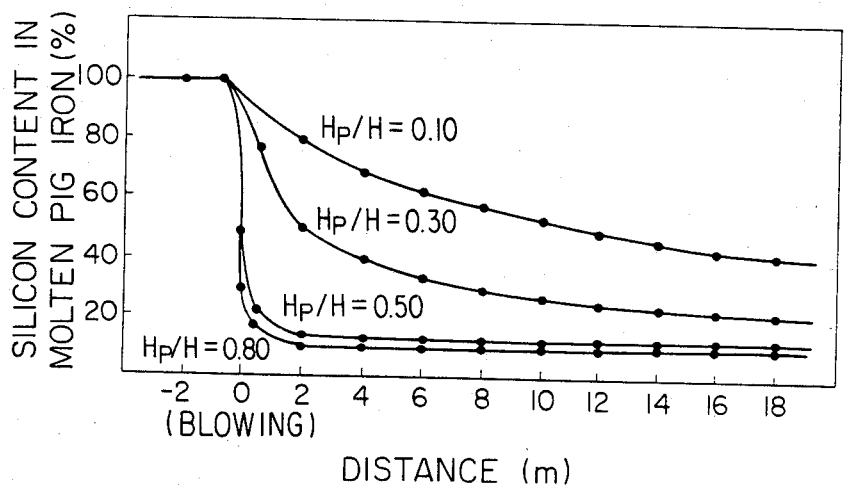
FIG. 6 is a graph illustrating the relationship between the silicon content in molten pig iron into which a granular chemical composition adjusting agent for removing silicon has been blown in accordance with the method of the present invention, on the one hand, and the flowing distance of molten pig iron from the blowing position of the chemical composition adjusting agent on the hot-metal runner, on the other hand.

FIG. 6 is a graph illustrating the relationship between the silicon content in molten pig iron into which the granular chemical composition adjusting agent for removing silicon has been blown in accordance with the method of the present invention, on the one hand, and the flowing distance of molten pig iron from the blowing position of the chemical composition adjusting agent on the hot-metal runner, on the other hand. FIG. 6 covers the case with a flow rate of molten pig iron of 7 tons/minute and a silicon content in molten pig iron of 0.40 wt. % before removal of silicon. As is clear from FIG. 6, when the ratio $H_P/H$ of the penetration depth $H_P$ of the granular chemical composition adjusting agent into molten pig iron in the hot-metal runner to the depth H of molten pig iron in the hot-metal runner is 0.50 or 0.80, removal of silicon is completed before a point almost immediately after blowing, by 2 m downstream from the blowing position of the granular chemical composition adjusting agent, and the silicon content in molten pig iron is reduced to about 16% of that before removal of silicon (the silicon content of 0.40 wt. % before removal of silicon is assumed to be 100%).

In the cases with the ratio $H_P/H$ of 0.10 and 0.30 which are outside the scope of the present invention, desiliconizing reaction slowly proceeds after blowing of the granular chemical composition adjusting agent. The silicon content in molten pig iron is not therefore rapidly reduced: at a point 18 m downstream of the blowing position, the silicon content being reduced only to 40% and 20%, respectively, of that before removal of silicon.

Thus, when the granular chemical composition adjusting agent for removing silicon is blown within the range of $0.5H \leqq H_P < H$, desiliconizing reaction from molten pig iron is completed almost at the same time as blowing of the granular chemical composition adjusting agent, and silicon in molten pig iron can be removed at a high efficiency. This tendency is observed also when blowing the granular chemical composition adjusting agent for removing phosphorus or the granular chemical composition adjusting agent for removing sulfur within the range of $0.5H \leqq H_P < H$.

According to the method of the present invention, therefore, it is possible not only to remove only one of impurities such as silicon, phosphorus and sulfur from molten pig iron in the hot-metal runner, but also to remove a plurality of kinds of impurities from molten pig iron in the hot-metal runner by removing sequentially one by one of these impurities or even removing simultaneously two kinds of impurities at multiple points along the flowing direction of molten pig iron.

For continuous removal of impurities according to the method of the present invention, various manners are available depending upon combination and sequence of impurities to be removed from molten pig iron. Such manners of removal include for example: (1) removal of silicon, and then removal of phosphorus; (2) removal of silicon, and then removal of sulfur; (3) removal of sulfur, and then removal of silicon; (4) removal of silicon, then removal of phosphorus, and then removal of sulfur; (5) removal of silicon, then removal of sulfur, and then removal of phosphorus; (6) removal of sulfur, then removal of silicon, and then removal of phosphorus; and (7) removal of silicon, and then simultaneous removal of phosphorus and sulfur.

Slag formed from a granular chemical composition adjusting agent for removing a kind of impurities should preferably be removed prior to blowing another granular chemical composition adjusting agent for removing another kind of impurities in order to improve the removing efficiency of such another granular chemical composition adjusting agent for removing such another kind of impurities, which is to be blown at a position in the downstream relative to the flowing direction of molten pig iron.

The formed slag may be removed by arranging in the hot-metal runner a slag skimmer for damming up slag so that the slag skimmer is positioned substantially at right angles to the flowing direction of molten pig iron in the hot-metal runner and the lowermost end of the slag skimmer is spaced apart from the bottom of the hot-metal runner, and providing a slag runner for discharging slag on the side wall of the hot-metal runner in the upstream of the slag skimmer relative to the flowing direction of molten pig iron.

Now, the present invention is described by means of some examples.

EXAMPLES 1 to 3

Silicon contained in molten pig iron flowing through the hot-metal runner was removed by substantially vertically arranging a lance above the hot-metal runner of a blast furnace so that the lowermost end of the lance is spaced apart by a prescribed distance from the surface of molten pig iron flowing through the hot-metal runner, and blowing, through the lance, a granular chemical composition adjusting agent for removing silicon by means of a carrier gas into molten pig iron flowing through the hot-metal runner, while controlling the penetration depth $H_P$ of the agent into molten pig iron within the range of $0.5H \leqq H_P < H$ in the scope of the present invention relative to the depth H of molten pig iron in the hot-metal runner, and then, the silicon removing efficiency and the amount of damage to the refractory at the bottom of the hot-metal runner were investigated. For comparison purposes, silicon contained in molten pig iron was removed by blowing a granular chemical composition adjusting agent for removing silicon into molten pig iron in a similar manner to the above, while controlling the penetration depth $H_P$ of the agent within the range of $H_P < 0.5H$ or $H_P > H$ outside the scope of the present invention, and then, the silicon removing efficiency and the amount of damage to the refractory at the bottom of the hot-metal runner were investigated.

Granular mill scale was used as the granular chemical composition adjusting agent for removing silicon. The penetration depth $H_P$ of the agent was controlled by adjusting the parameters in the following equation within the ranges shown in the blowing conditions mentioned below:

$$H_P = M \cdot G \cdot exp(-\bar{r})/(D + 0.02H_L)^2$$

In the above equation: $H_P$: penetration depth of the granular chemical composition adjusting agent into molten pig iron in the hot-metal runner (mm), M: flow rate of the granular chemical composition adjusting agent (kg/minute), G: flow rate of the carrier gas ($Nm^3$/minute), $\bar{r}$: average particle size of the granular chemical composition adjusting agent (mm), D: inside diameter of the lance (mm), and $H_L$ : distance between the surface of molten pig iron in the hot-metal runner and the lowermost end of the lance (mm).

Blowing conditions were as follows:

(1) Flow rate of molten pig iron in the hot-metal runner: 7 tons/minute, (2) Depth H of molten pig iron in the hot-metal runner from 50 to 400 mm, (3) Flow rate M of the granular chemical composition adjusting agent: from 100 to 400 kg/minute, (4) Particle size of the granular chemical composition adjusting agent:
maximum particle size: 1 mm,
average particle size $\bar{r}$: 0.3 mm, (5) Kind of the carrier gas: air, (6) Flow rate G of the carrier gas: from 5 to 13 $Nm^3$/minute, (7) Inside diameter D of the lance: 32 mm, and (8) Distance $H_L$ between the surface of molten pig iron in the hot-metal runner and the lowermost end of the lance: 200 mm.

The resultant silicon removing efficiency and the amount of damage to the refractory at the bottom of the hot-metal runner are shown in Table 1, and the contents of main constituents and temperatures of molten pig iron before and after removal of silicon are shown in Table 2.

TABLE 1

| | | $H_P/H$ | Consumption of adjusting agent (kg/ton) | Desilicon-[1] izing ratio (%) | Damage to refractory at bottom of hot-metal runner |
|---|---|---|---|---|---|
| Example | 1 | 0.55 | 21 | 70 | Almost negligible |
| | 2 | 0.85 | 21 | 73 | Almost negligible |
| | 3 | 0.95 | 21 | 73 | Almost negligible |
| Comparison Case | 1 | >1 | 21 | 73 | Serious |
| | 2 | 0.2 | 30 | 33 | None |
| | 3 | 0.4 | 30 | 53 | None |

[1]Desiliconizing ratio = $([Si]_o - [Si])/[Si]_o \times 100$, where $[Si]_o$: silicon content before removal, [Si]: silicon content after removal.

TABLE 2

| | | Contents of main constituents in molten pig iron (wt. %) | | | | | | | | | | temperature of molten pig iron (°C.) | |
|---|---|---|---|---|---|---|---|---|---|---|---|---|---|
| | | Before removal of Si | | | | | After removal of Si | | | | | Before removal of Si | After removal of Si |
| | | C | Si | Mn | P | S | C | Si | Mn | P | S | | |
| Example | 1 | 4.57 | 0.30 | 0.57 | 0.109 | 0.040 | 4.40 | 0.09 | 0.47 | 0.107 | 0.039 | 1490 | 1480 |
| | 2 | 4.70 | 0.30 | 0.55 | 0.107 | 0.039 | 4.50 | 0.08 | 0.35 | 0.105 | 0.038 | 1495 | 1485 |
| | 3 | 4.61 | 0.30 | 0.56 | 0.106 | 0.039 | 4.42 | 0.08 | 0.36 | 0.104 | 0.038 | 1500 | 1490 |
| Comparison Case | 1 | 4.60 | 0.30 | 0.55 | 0.110 | 0.040 | 4.40 | 0.08 | 0.35 | 0.108 | 0.039 | 1480 | 1470 |
| | 2 | 4.65 | 0.30 | 0.56 | 0.110 | 0.040 | 4.55 | 0.20 | 0.46 | 0.108 | 0.039 | 1480 | 1465 |
| | 3 | 4.63 | 0.30 | 0.56 | 0.109 | 0.041 | 4.43 | 0.14 | 0.47 | 0.107 | 0.040 | 1480 | 1465 |

As is clear from Tables 1 and 2, in Examples 1 to 3 in which the penetration depth $H_P$ of the granular chemical composition adjusting agent for removing silicon relative to the depth H of molten pig iron was within the range of $0.5H \leqq H_P < H$, silicon contained in molten pig iron was removed at a high efficiency, and damage to the refractory at the bottom of the hot-metal runner caused by blowing of the granular chemical composition adjusting agent was inhibited to a level almost negligible. In Comparison Case 1 in which the penetration depth $H_P$ was within the range $H_P > H$, in contrast, silicon contained in molten pig iron was removed at a high efficiency, but there was a serious damage to the refractory at the bottom of the hot-metal runner. In Comparison Cases 2 and 3 in which the penetration depth $H_P$ was within the range of $H_P < 0.5H$, there was no damage to the refractory at the bottom of the hot-metal runner, but instead, the silicon removing efficiency was very low.

EXAMPLES 4 to 7

TABLE 3-continued

| | | $H_P/H$ | Consumption of adjusting agent (kg/ton) | Dephosphorizing ratio (%)[2] | Damage to refractory at bottom of hot-metal runner |
|---|---|---|---|---|---|
| | | | | | negligible |
| | 6 | 0.88 | 40 | 80 | Almost negligible |
| | 7 | 0.95 | 50 | 82 | Almost negligible |
| Comparison Case | 4 | >1 | 50 | 80 | Serious |
| | 5 | 0.2 | 50 | 26 | None |
| | 6 | 0.4 | 50 | 45 | None |

[2]Dephosphorizing ratio = $([P]_o - [P])/[P]_o \times 100$, where, $[P]_o$: phosphorus content before removal, [P]: phosphorus content after removal.

TABLE 4

| | | Contents of main constituents in molten pig iron (wt %) | | | | | | | | | | temperature of molten pig iron (°C.) | |
|---|---|---|---|---|---|---|---|---|---|---|---|---|---|
| | | Before removal of P | | | | | After removal of P | | | | | Before removal of P | After removal of P |
| | | C | Si | Mn | P | S | C | Si | Mn | P | S | | |
| Example | 4 | 4.40 | 0.16 | 0.35 | 0.100 | 0.040 | 4.20 | 0.03 | 0.17 | 0.025 | 0.022 | 1410 | 1380 |
| | 5 | 4.39 | 0.15 | 0.36 | 0.101 | 0.039 | 4.19 | 0.02 | 0.15 | 0.020 | 0.021 | 1420 | 1380 |
| | 6 | 4.40 | 0.15 | 0.35 | 0.100 | 0.040 | 4.19 | 0.02 | 0.15 | 0.020 | 0.020 | 1430 | 1380 |
| | 7 | 4.41 | 0.14 | 0.36 | 0.103 | 0.041 | 4.20 | 0.02 | 0.14 | 0.019 | 0.020 | 1440 | 1380 |
| Comparison Case | 4 | 4.40 | 0.14 | 0.33 | 0.100 | 0.040 | 4.20 | 0.02 | 0.18 | 0.020 | 0.020 | 1445 | 1385 |
| | 5 | 4.39 | 0.15 | 0.34 | 0.101 | 0.041 | 4.35 | 0.10 | 0.30 | 0.075 | 0.029 | 1410 | 1400 |
| | 6 | 4.41 | 0.14 | 0.36 | 0.102 | 0.040 | 4.33 | 0.07 | 0.26 | 0.056 | 0.024 | 1425 | 1402 |

Phosphorus contained in low-silicon molten pig iron tapped from the blast furnace under a low-silicon operation was removed by blowing a granular chemical composition adjusting agent for removing phosphorus into molten pig iron in the same manner as in Example 1 while controlling the penetration depth $H_P$ of the agent into molten pig iron within the range of $0.5H \leqq H_P < H$ in the scope of the present invention relative to the depth H of molten pig iron in the hot-metal runner, and then, the phosphorus removing efficiency and the amount of damage to the refractory at the bottom of the hot-metal runner were investigated. For comparison purposes, phosphorus contained in low-silicon molten pig iron was removed by blowing a granular chemical composition adjusting agent for removing phosphorus into molten pig iron in a similar manner to the above, while controlling the penetration depth $H_P$ of the agent within the range of $H_P < 0.5$ or $H_P > H$ outside the scope of the present invention, and then, the phosphorus removing efficiency and the amount of damage to the refractory at the bottom of the hot-metal runner were investigated.

A mixture of granular mill scale, granular calcined lime and granular fluorite (mill scale: calcined lime: granular fluorite = 30 wt. %: 55 wt. %: 15 wt. %) was used as the granular chemical composition adjusting agent for removing phosphorus. The blowing conditions of the agent were the same as those in Examples 1 to 3.

The results are shown in Tables 3 and 4.

TABLE 3

| | | $H_P/H$ | Consumption of adjusting agent (kg/ton) | Dephosphorizing ratio (%)[2] | Damage to refractory at bottom of hot-metal runner |
|---|---|---|---|---|---|
| Example | 4 | 0.70 | 20 | 75 | Almost negligible |
| | 5 | 0.78 | 30 | 80 | Almost |

As is clear from Tables 3 and 4, in Examples 4 to 7 in which the penetration depth $H_P$ of the granular chemical composition adjusting agent for removing phosphorus relative to the depth H of molten pig iron was within the range of $0.5H \leqq H_P < H$, phosphorus contained in molten pig iron was removed at a high efficiency, and damage to the refractory at the bottom of the hot-metal runner caused by blowing of the granular chemical composition adjusting agent was inhibited to a level almost negligible. In Comparison Case 4 in which the penetration depth $H_P$ was within the range of $H_P > H$, in contrast, phosphorus contained in molten pig iron was removed at a high efficiency, but there was a serious damage to the refractory at the bottom of the hot-metal runner. In Comparison Cases 5 and 6 in which the penetration depth $H_P$ was within the range of $H_P < 0.5H$, there was no damage to the refractory at the bottom of the hot-metal runner, but instead, the phosphorus removing efficiency was very low.

EXAMPLES 8 to 10

Sulfur contained in molten pig iron flowing through the hot-metal runner was removed by blowing a granular chemical composition adjusting agent for removing sulfur into molten pig iron in the same manner as in Example 1 while controlling the penetration depth $H_P$ of the agent into molten pig iron within the range of $0.5H \leqq H_P < H$ in the scope of the present invention relative to the depth H of molten pig iron in the hot-metal runner, and then, the sulfur removing efficiency and the amount of damage to the refractory at the bottom of the hot-metal runner were investigated. For comparison purposes, sulfur contained in molten pig iron was removed by blowing a granular chemical composition adjusting agent for removing sulfur into molten pig iron in a similar manner to the above, while controlling the penetration depth $H_P$ of the agent within the range of $H_P < 0.5$ or $H_P > H$ outside the scope of the present invention, and then, the sulfur removing efficiency and the amount of damage to the refractory at the bottom of the hot-metal runner were investigated.

A mixture of granular calcined lime and granular fluorite (calcined lime: fluorite=98 wt. %: 2 wt. %) was used as the granular chemical composition adjusting agent for removing sulfur. The blowing conditions of the agent were the same as those in Examples 1 to 3.

The results are shown in Tables 5 and 6.

TABLE 5

| | | $H_P/H$ | Consumption of adjusting agent (kg/ton) | Desulfurizing ratio[3] (%) | Damage to refractory at bottom of hot-metal runner |
|---|---|---|---|---|---|
| Example | 8 | 0.70 | 5 | 80 | Almost negligible |
| | 9 | 0.80 | 10 | 90 | Almost negligible |
| | 10 | 0.90 | 15 | 95 | Almost negligible |
| Comparison Case | 7 | >1 | 15 | 95 | Serious |
| | 8 | 0.2 | 15 | 25 | None |
| | 9 | 0.4 | 15 | 45 | None |

[3]Desulfurizing ratio = $([S]_o - [S])/[S]_o \times 100$, where, $[S]_o$: sulfur content before removal, and [S]: sulfur content after removal.

TABLE 6

| | | Contents of main constituents in molten pig iron (wt %) | | | | | | | | | | temperature of molten pig iron (°C.) | |
|---|---|---|---|---|---|---|---|---|---|---|---|---|---|
| | | Before removal of S | | | | | After removal of S | | | | | Before removal of S | After removal of S |
| | | C | Si | Mn | P | S | C | Si | Mn | P | S | | |
| Example | 8 | 4.60 | 0.30 | 0.50 | 0.100 | 0.039 | 4.59 | 0.28 | 0.50 | 0.100 | 0.008 | 1480 | 1477 |
| | 9 | 4.60 | 0.30 | 0.50 | 0.101 | 0.040 | 4.59 | 0.27 | 0.50 | 0.101 | 0.004 | 1490 | 1485 |
| | 10 | 4.60 | 0.30 | 0.50 | 0.105 | 0.040 | 4.59 | 0.25 | 0.50 | 0.105 | 0.002 | 1490 | 1482 |
| Comparison Case | 7 | 4.65 | 0.31 | 0.54 | 0.101 | 0.040 | 4.64 | 0.29 | 0.54 | 0.100 | 0.002 | 1483 | 1479 |
| | 8 | 4.67 | 0.29 | 0.56 | 0.102 | 0.040 | 4.67 | 0.29 | 0.56 | 0.101 | 0.030 | 1485 | 1482 |
| | 9 | 4.66 | 0.33 | 0.55 | 0.100 | 0.040 | 4.66 | 0.32 | 0.55 | 0.100 | 0.022 | 1485 | 1482 |

As is clear from Tables 5 and 6, in Examples 8 to 10 in which the penetration depth $H_P$ of the granular chemical composition adjusting agent for removing sulfur relative to the depth H of molten pig iron was within the range of $0.5H \leqq H_P < H$, sulfur contained in molten pig iron was removed at a high efficiency, and damage to the refractory at the bottom of the hot-metal runner caused by blowing of the granular chemical composition adjusting agent was inhibited to a level almost negligible. In comparison Case 7 in which the penetration depth $H_P$ was within the range of $H_P > H$, in contrast, sulfur contained in molten pig iron was removed at a high efficiency, but there was a serious damage to the refractory at the bottom of the hot-metal runner. In Comparison Cases 8 and 9 in which the penetration depth $H_P$ was within the range of $H_P < 0.5H$, there was no damage to the refractory at the bottom of the hot-metal runner, but instead, the sulfur removing efficiency was very low.

EXAMPLE 11

A first lance and a second lance were substantially vertically arranged above a hot-metal runner of a blast furnace in this order relative to the flowing direction of molten pig iron in the hot-metal runner so that the lowermost ends of the lances were spaced apart by a prescribed distance from the surface of molten pig iron flowing through the hot-metal runner. Firstly, silicon contained in molten pig iron flowing through the hot-metal runner was removed by blowing, through the first lance, a granular chemical composition adjusting agent for removing silicon by means of a carrier gas into molten pig iron flowing through the hot-metal runner, while controlling the penetration depth $H_P$ of the agent into molten pig iron so as to be $H_P=0.8H$ within the scope of the present invention relative to the depth H of molten pig iron in the hot-metal runner. Then, after removing the formed slag, phosphorus contained in molten pig iron flowing through the hot-metal runner was removed by blowing, through the second lance, a granular chemical composition adjusting agent for removing phosphorus by means of a carrier gas into molten pig iron flowing through the hot-metal runner, while controlling the penetration depth $H_P$ of the agent so as to be $H_P=0.8H$ similarly to the above. Then, the removing efficiency of silicon and phosphorus and the amount of damage to the refractory at the bottom of the hot-metal runner were investigated.

The blowing conditions of the agents were the same as those in Examples 1 to 3.

The results are shown in Table 7.

TABLE 7

| | | Contents of main constituents in molten pig iron (wt %) | | | | | Granular chemical composition adjusting agent used | | Consumption of adjusting agent (Kg/ton) | Removing efficiency (%) |
|---|---|---|---|---|---|---|---|---|---|---|
| | | C | Si | Mn | P | S | | | | |
| Example 11 | Before removal of Si & P | 4.70 | 0.35 | 0.45 | 0.110 | 0.040 | — | | — | — |
| | After removal of Si | 4.60 | 0.06 | 0.20 | 0.100 | 0.035 | Mill scale: | 100 wt % | 35 | for Si: 83 |
| | After removal of P | 4.40 | trace | 0.20 | 0.010 | 0.010 | Mill scale: | 40 wt % | 50 | for P: 90 |
| | | | | | | | Calcined lime: | 40 wt % | | |
| | | | | | | | Flourite: | 10 wt % | | |
| | | | | | | | Sodium chloride: | 10 wt % | | |

As is clear from Table 7, silicon and phosphorus were removed in succession at a high efficiency by blowing sequentially, along the flowing direction of molten pig iron in the hot-metal runner, the granular chemical composition adjusting agent for removing silicon, and then the granular chemical composition adjusting agent for removing phosphorus into molten pig iron flowing through the hot-metal runner, while controlling the penetration depth $H_P$ of the respective granular chemical composition adjusting agents into molten pig iron so as to be $H_P=0.8H$ relative to the depth H of molten pig iron in the hot-metal runner. In addition, there was observed almost no damage to the refractory at the bottom of the hot-metal runner caused by blowing of the granular chemical composition adjusting agents.

EXAMPLE 12

A first lance and a second lance were arranged, as in Example 11, above a hot-metal runner of a blast furnace. Firstly, sulfur contained in molten pig iron flowing through the hot-metal runner was removed by blowing, through the first lance, a granular chemical composition adjusting agent for removing sulfur by means of a carrier gas into molten pig iron flowing through the hot-metal runner, while controlling the penetration depth $H_P$ of the agent into molten pig iron so as to be $H_P=0.8H$ within the scope of the present invention relative to the depth H of molten pig iron in the hot-metal runner. Then, after removing the formed slag, silicon contained in molten pig iron flowing through the hot-metal runner was removed by blowing, through the second lance, a granular chemical composition adjusting agent for removing silicon by means of a carrier gas into molten pig iron flowing through the hot-metal runner, while controlling the penetration depth $H_P$ of the agent so as to be $H_P=0.8H$ similarly to the above. Then, the removing efficiency of sulfur and silicon and the amount of damage to the refractory at the bottom of the hot-metal runner were investigated.

The blowing conditions of the agents were the same as those in the Examples 1 to 3.

The results are shown in Table 8.

TABLE 8

| | | Contents of main constituents in molten pig iron (wt %) | | | | | Granular chemical composition adjusting agent used | | Consumption of adjusting agent (Kg/ton) | Removing efficiency (%) |
|---|---|---|---|---|---|---|---|---|---|---|
| | | C | Si | Mn | P | S | | | | |
| Example 12 | Before removal of S and Si | 4.70 | 0.35 | 0.45 | 0.110 | 0.040 | — | | — | — |
| | After removal of S | 4.70 | 0.32 | 0.45 | 0.110 | 0.002 | Calcined lime: | 95 wt % | 10 | for S: 95 |
| | | | | | | | Flourite: | 5 wt % | | |
| | After removal of Si | 4.60 | 0.05 | 0.30 | 0.100 | 0.0016 | Mill scale: | 100 wt % | 15 | for Si: 84 |

As is clear from Table 8, sulfur and silicon were removed in succession at a high efficiency by blowing sequentially, along the flowing direction of molten pig iron in the hot-metal runner, the granular chemical composition adjusting agent for removing sulfur, and then the granular chemical composition adjusting agent for removing silicon into molten pig iron flowing through the hot-metal runner, while controlling the penetration depth $H_P$ of the respective granular chemical composition adjusting agents into molten pig iron so as to be $H_P=0.8H$ relative to the depth H of molten pig iron in the hot-metal runner. In addition, there was observed almost no damage to the refractory at the bottom of the hot-metal runner caused by blowing of the granular chemical composition adjusting agents.

EXAMPLES 13 to 16

Phosphorus and sulfur contained in low-silicon molten pig iron tapped from a blast furnace under a low-silicon operation were simultaneously removed by blowing a granular chemical composition adjusting agent for removing phosphorus and sulfur into molten pig iron in the same manner as in Examples 4 to 7 while controlling the penetration depth $H_P$ of the agent into molten pig iron within the range of $0.5H \leqq H_P < H$ in the scope of the present invention relative to the depth of molten pig iron in the hot-metal runner, and then, the removing efficiency of phosphorus and sulfur and the amount of damage to the refractory at the bottom of the hot-metal runner were investigated. For comparison purposes, phosphorus and sulfur in low-silicon molten pig iron were simultaneously removed by blowing a granular chemical composition adjusting agent for removing phosphorus and sulfur into molten pig iron in a manner similar to the above, while controlling the penetration depth $H_P$ of the agent within the range of $H_P<0.5H$ or $H_P>H$ outside the scope of the present invention, and then, the removing efficiency of phosphorus and sulfur and the amount of damage to the refractory at the bottom of the hot-metal runner were investigated.

A mixture of granular mill scale and granular soda ash (mill scale: soda ash = 50 wt. %: 50 wt. %) was used as the granular chemical composition adjusting agent for removing phosphorus and sulfur. The blowing conditions of the agent were the same as those in Examples 1 to 3.

The results are shown in Tables 9 and 10.

TABLE 9

| | | $H_P/H$ | Consumption of adjusting agent (Kg/ton) | Dephosphorizing ratio (%) | Desulfurizing ratio (%) | Damage to refractory at bottom of hot-metal runner |
|---|---|---|---|---|---|---|
| Example | 13 | 0.70 | 20 | 70 | 80 | Almost negligible |
| | 14 | 0.78 | 30 | 80 | 90 | Almost negligible |
| | 15 | 0.88 | 40 | 90 | 95 | Almost negligible |
| | 16 | 0.95 | 50 | 95 | 98 | Almost negligible |
| Comparison Case | 10 | >1 | 50 | 95 | 98 | Serious |
| | 11 | 0.2 | 50 | 26 | 37 | None |
| | 12 | 0.4 | 50 | 45 | 55 | None |

TABLE 10

| | | Contents of main constituents in molten pig iron (wt. %) | | | | | | | | | | temperature of molten pig iron (°C.) | |
|---|---|---|---|---|---|---|---|---|---|---|---|---|---|
| | | Before removal of P and S | | | | | After removal P and S | | | | | Before removal | After removal |
| | | C | Si | Mn | P | S | C | Si | Mn | P | S | of P & S | of P & S |
| Example | 13 | 4.40 | 0.05 | 0.35 | 0.100 | 0.040 | 4.20 | 0.02 | 0.30 | 0.030 | 0.008 | 1410 | 1380 |
| | 14 | 4.39 | 0.06 | 0.36 | 0.101 | 0.039 | 4.19 | 0.01 | 0.32 | 0.020 | 0.004 | 1420 | 1380 |
| | 15 | 4.40 | 0.04 | 0.35 | 0.100 | 0.040 | 4.19 | 0.02 | 0.33 | 0.010 | 0.002 | 1430 | 1380 |
| | 16 | 4.41 | 0.05 | 0.36 | 0.103 | 0.041 | 4.20 | 0.01 | 0.33 | 0.005 | 0.001 | 1440 | 1380 |
| Comparison | 10 | 4.40 | 0.04 | 0.33 | 0.100 | 0.040 | 4.20 | trace | 0.32 | 0.005 | 0.001 | 1445 | 1385 |
| Case | 11 | 4.39 | 0.05 | 0.34 | 0.101 | 0.041 | 4.35 | 0.04 | 0.34 | 0.075 | 0.026 | 1410 | 1400 |
| | 12 | 4.41 | 0.06 | 0.36 | 0.102 | 0.040 | 4.33 | 0.05 | 0.36 | 0.056 | 0.018 | 1425 | 1402 |

As is clear from Tables 9 and 10, in Examples 13 to 16 in which the penetration depth $H_P$ of the granular chemical composition adjusting agent for removing phosphorus and sulfur relative to the depth H of molten pig iron was within the range of $0.5H \leqq H_P < H$, phosphorus and sulfur contained in molten pig iron were removed at a high efficiency, and damage to the refractory at the bottom of the hot-metal runner caused by blowing of the granular chemical composition adjusting agent was inhibited to a level almost negligible. In Comparison Case 10 in which the penetration depth $H_P$ was within the range of $H_P > H$, in contrast, phosphorus and sulfur contained in molten pig iron were removed at a high efficiency, but there was a serious damage to the refractory at the bottom of the hot-metal runner. In Comparison Cases 11 and 12 in which the penetration depth $H_P$ was within the range of $H_P < 0.5H$, there was no damage to the refractory at the bottom of the hot-metal runner, but instead, the removing efficiency of phosphorus and sulfur was very low.

TABLE 11

| | | Contents of main constituents in molten pig iron (wt %) | | | | | Granular chemical composition adjusting agent used | | Consumption of adjusting agent (Kg/ton) | Removing efficiency (%) |
|---|---|---|---|---|---|---|---|---|---|---|
| | | C | Si | Mn | P | S | | | | |
| Example 17 | Before removal of Si, P & S | 4.70 | 0.35 | 0.45 | 0.110 | 0.040 | — | | — | — |
| | After removal of Si | 4.60 | 0.06 | 0.20 | 0.100 | 0.035 | Mill scale: | 100 wt % | 35 | for Si: 83 |
| | After removal of P | 4.40 | trace | 0.20 | 0.012 | 0.015 | Mill scale: | 55 wt % | 50 | for P: 88 |
| | | | | | | | Calcined lime: | 30 wt % | | |
| | | | | | | | Fluorite: | 15 wt % | | |
| | After removal of S | 4.40 | trace | 0.20 | 0.012 | 0.001 | Calcined lime: | 95 wt % | 8 | for S: 93 |
| | | | | | | | Fluorite: | 5 wt % | | |

EXAMPLE 17

A first lance, a second lance, and a third lance were substantially vertically arranged above a hot-metal runner of a blast furnace in this order relative to the flowing direction of molten pig iron in the hot-metal runner so that the lowermost ends of the lances were spaced apart by a prescribed distance from the surface of molten pig iron flowing through the hot-metal runner. Firstly, silicon contained in molten pig iron flowing through the hot-metal runner was removed by blowing, through the first lance, a granular chemical composition adjusting agent for removing silicon by means of a carrier gas into molten pig iron flowing through the hot-metal runner, while controlling the penetration depth $H_p$ of the agent into molten pig iron so as to be $H_p = 0.8H$ within the scope of the present invention relative to the depth H of molten pig iron in the hot-metal runner. Then, after removing the formed slag, phosphorus contained in molten pig iron flowing through the hot-metal runner was removed by blowing, through the second lance, a granular chemical composition adjusting agent for removing phosphorus by means of a carrier gas into molten pig iron flowing through the hot-metal runner, while controlling the penetration depth $H_p$ of the agent so as to be $H_p = 0.8H$ similarly to the above. Then, after removing the formed slag, sulfur contained in molten pig iron flowing through the hot-metal runner was removed by blowing, through the third lance, a granular chemical composition adjusting agent for removing sulfur by means of a carrier gas into molten pig iron flowing through the hot-metal runner, while controlling the penetration depth $H_p$ of the agent so as to be $H_p = 0.8H$ similarly to the above. Then, the removing efficiency of silicon, phosphorus and sulfur and the amount of damage to the refractory at the bottom of the hot-metal runner were investigated.

The blowing conditions of the agents were the same as those in Examples 1 to 3.

The results are shown in Table 11.

As is clear from Table 11, silicon, phosphorus and sulfur were removed in succession at a high efficiency by blowing sequentially, along the flowing direction of molten pig iron in the hot-metal runner, first the granular chemical composition adjusting agent for removing silicon, then the granular chemical composition adjusting agent for removing phosphorus, and then the granular chemical composition adjusting agent for removing sulfur into molten pig iron flowing through the hot-metal runner, while controlling the penetration depth $H_P$ of the respective granular chemical composition adjusting agents into molten pig iron so as to be $H_P = 0.8H$ relative to the depth H of molten pig iron in the hot-metal runner. In addition, there was observed almost no damage to the refractory at the bottom of the hot-metal runner caused by blowing of the granular chemical composition adjusting agents.

EXAMPLE 18

A first lance, a second lance, and a third lance were substantially vertically arranged above a hot-metal runner of a blast furnace in the same manner as in Example 17. Firstly, sulfur contained in molten pig iron flowing through the hot-metal runner was removed by blowing, through the first lance, a granular chemical composition adjusting agent for removing sulfur by means of a carrier gas into molten pig iron flowing through the hot-metal runner, while controlling the penetration depth $H_P$ of the agent into molten pig iron so as to be $H_P=0.8H$ within the scope of the present invention relative to the depth H of molten pig iron in the hot-metal runner. Then, after removing the formed slag, silicon contained in molten pig iron flowing through the hot-metal runner was removed by blowing, through the second lance, a granular chemical composition adjusting agent for removing silicon by means of a carrier gas into molten pig iron flowing through the hot-metal runner, while controlling the penetration depth $H_P$ of the agent so as to be $H_P=0.8H$ similarly to the above. Then, after removing the formed slag, phosphorus contained in molten pig iron flowing through the hot-metal runner was removed by blowing, through the third lance, a granular chemical composition adjusting agent for removing phosphorus by means of a carrier gas into molten pig iron flowing through the hot-metal runner, while controlling the penetration depth $H_P$ of the agent so as to be $H_P=0.8H$ similarly to the above. Then, the removing efficiency of sulfur, silicon and phosphorus and the amount of damage to the refractory at the bottom of the hot-metal runner were investigated.

The blowing conditions of the agents were the same as those in Examples 1 to 3.

The results are shown in Table 12.

TABLE 12

| | | Contents of main constituents in molten pig iron (wt %) | | | | | Granular chemical composition adjusting agent used | | Consumption of adjusting agent (Kg/ton) | Removing efficiency (%) |
|---|---|---|---|---|---|---|---|---|---|---|
| | | C | Si | Mn | P | S | | | | |
| Example 18 | Before removal of S, Si & P | 4.70 | 0.35 | 0.45 | 0.110 | 0.040 | — | | — | — |
| | After removal of S | 4.70 | 0.32 | 0.45 | 0.110 | 0.004 | Limestone:<br>Fluorite: | 95 wt %<br>5 wt % | 8 | 90 |
| | After removal of Si | 4.60 | 0.05 | 0.20 | 0.100 | 0.0035 | Mill scale: | 100 wt % | 35 | 84 |
| | After removal of P | 4.40 | trace | 0.15 | 0.012 | 0.0014 | Mill scale:<br>Calcined lime:<br>Fluorite: | 40 wt %<br>40 wt %<br>20 wt % | 40 | 88 |

As is clear from Table 12, sulfur, silicon and phosphorus were removed in succession at a high efficiency by blowing sequentially, along the flowing direction of molten pig iron in the hot-metal runner, first the granular chemical composition adjusting agent for removing sulfur, then the granular chemical composition adjusting agent for removing silicon, and then the granular chemical composition adjusting agent for removing phosphorus into molten pig iron flowing through the hot-metal runner, while controlling the penetration depth $H_P$ of the respective granular chemical composition adjusting agents into molten pig iron so as to be $H_P=0.8H$ relative to the depth H of molten pig iron in the hot-metal runner. In addition, there was observed almost no damage to the refractory at the bottom of the hot-metal runner caused by blowing of the granular chemical composition adjusting agents.

EXAMPLE 19

A first lance and a second lance were arranged, as in Example 11, above a hot-metal runner of a blast furnace. Firstly, silicon contained in molten pig iron flowing through the hot-metal runner was removed by blowing, through the first lance, a granular chemical composition adjusting agent for removing silicon by means of a carrier gas into molten pig iron flowing through the hot-metal runner, while controlling the penetration depth $H_P$ of the agent into molten pig iron so as to be $H_P=0.8H$ within the scope of the present invention relative to the depth of H of molten pig iron in the hot-metal runner. Then, after removing the formed slag, phosphorus and sulfur contained in molten pig iron flowing through the hot-metal runner were simultaneously removed by blowing, through the second lance, a granular chemical composition adjusting agent for removing phosphorus and sulfur by means of a carrier gas into molten pig iron flowing through the hot-metal runner, while controlling the penetration depth $H_P$ of the agent so as to be $H_P=0.8H$ similarly to the above. Then, the removing efficiency of silicon, phosphorus and sulfur and the amount of damage to the refractory at the bottom of the hot-metal runner were investigated.

The blowing conditions of the agents were the same as those in Examples 1 to 3.

The results are shown in Table 13.

TABLE 13

| | | Contents of main constituents in molten pig iron (wt %) | | | | | Granular chemical composition adjusting agent used | | Comsumption of adjusting agent (Kg/ton) | Removing efficiency (%) |
|---|---|---|---|---|---|---|---|---|---|---|
| | | C | Si | Mn | P | S | | | | |
| Example 19 | Before removal of Si, P & S | 4.70 | 0.35 | 0.45 | 0.110 | 0.040 | — | | — | — |
| | After removal of Si | 4.60 | 0.06 | 0.20 | 0.100 | 0.035 | Mill scale: | 100 wt % | 35 | for Si: 83 |
| | After removal of P & S | 4.40 | trace | 0.20 | 0.010 | 0.001 | Soda ash:<br>Mill scale: | 50 wt %<br>50 wt % | 40 | for P: 90<br>for S: 97 |

As is clear from Table 13, silicon, phosphorus and sulfur were removed in succession at a high efficiency by blowing sequentially, along the flowing direction of molten pig iron in the hot-metal runner, first the granular chemical composition adjusting agent for removing silicon, and then the granular chemical composition adjusting agent for removing phosphorus and sulfur into molten pig iron flowing through the hot-metal runner, while controlling the penetration depth $H_P$ of the respective granular chemical composition adjusting agents into molten pig iron so as to be $H_P=0.8H$ relative to the depth H of molten pig iron in the hot-metal runner. In addition, there was observed almost no damage to the refractory at the bottom of the hot-metal runner caused by blowing of the granular chemical composition adjusting agents.

EXAMPLES 20 to 22

A lance was substantially vertically arranged above a hot-metal runner of a blast furnace in the same manner as in Example 1. Carbon content in molten pig iron flowing through the hot-metal runner was further increased by blowing, through the lance, a granular chemical composition adjusting agent for further increasing the carbon content by means of a carrier gas into molten pig iron flowing through the hot-metal runner, while controlling the penetration depth $H_P$ of the agent into molten pig iron within the range of $0.5H \leqq H_p < H$ in the scope of the present invention relative to the depth H of molten pig iron in the hot-metal runner. The solubility of carbon and the amount of damage to the refractory at the bottom of the hot-metal runner were investigated. For comparison purposes, carbon content in molten pig iron flowing through the hot-metal runner was further increased by blowing, through the lance, a granular chemical composition adjusting agent for further increasing the carbon content by means of a carrier gas into molten pig iron flowing through the hot-metal runner in a similar manner to the above, while controlling the penetration depth $H_P$ of the agent within the range of $H_P<0.5H$ or $H_P>H$ outside the scope of the present invention. Then, the solubility of carbon and the amount of damage to the refractory at the bottom of the hot-metal runner were investigated.

At least one of coke breeze, coal fine and ash-removed coal fine was used as the granular chemical composition adjusting agent for further increasing the carbon content.

The blowing conditions of the agent were the same as those in Examples 1 to 3.

The results are shown in Tables 14 and 15.

TABLE 14

| | | $H_P/H$ | Granular chemical composition adjusting agent used | Consumption of adjusting agent (Kg/ton) | Carbon[4] solubility (%) | Damage to refractory at bottom of hot-metal runner |
|---|---|---|---|---|---|---|
| Example | 20 | 0.80 | Coke breeze | 15 | 90 | Almost negligible |
| | 21 | 0.80 | Coal fine | 15 | 80 | " |
| | 22 | 0.80 | Ash-removed Coal fine | 15 | 95 | " |
| Comparison Case | 13 | >1 | Coke breeze | 15 | 90 | Serious |
| | 14 | >1 | Coal fine | 15 | 80 | " |
| | 15 | >1 | Ash-removed Coal fine | 15 | 95 | " |

[4]Carbon solubility = C solution/C total × 100, where, C total: quantity of carbon blown into molten pig iron, and C solution: quantity of carbon dissolved into molten pig iron from carbon blown.

TABLE 15

| | | Contents of main constituents in molten pig iron (wt. %) | | | | | | | | | | Temperature of molten pig iron (°C.) | |
|---|---|---|---|---|---|---|---|---|---|---|---|---|---|
| | | Before C addition | | | | | After C addition | | | | | Before | After |
| | | C | Si | Mn | P | S | C | Si | Mn | P | S | C addition | C addition |
| Example | 20 | 4.40 | 0.30 | 0.50 | 0.110 | 0.040 | 4.95 | 0.30 | 0.50 | 0.110 | 0.050 | 1500 | 1480 |
| | 21 | 4.40 | 0.30 | 0.50 | 0.110 | 0.040 | 4.90 | 0.30 | 0.50 | 0.113 | 0.052 | 1510 | 1490 |
| | 22 | 4.40 | 0.30 | 0.50 | 0.110 | 0.030 | 5.00 | 0.30 | 0.50 | 0.110 | 0.032 | 1510 | 1490 |
| Comparison Case | 13 | 4.35 | 0.30 | 0.51 | 0.106 | 0.040 | 4.90 | 0.30 | 0.51 | 0.110 | 0.050 | 1495 | 1475 |
| | 14 | 4.33 | 0.29 | 0.49 | 0.110 | 0.042 | 4.83 | 0.29 | 0.49 | 0.113 | 0.055 | 1496 | 1476 |
| | 15 | 4.34 | 0.31 | 0.55 | 0.103 | 0.039 | 4.94 | 0.31 | 0.55 | 0.106 | 0.045 | 1498 | 1477 |

As is clear from Tables 14 and 15, in Examples 20 to 22 in which the penetration depth $H_P$ of the granular chemical composition adjusting agents for further increasing the carbon content in molten pig iron was within the range of $0.5H \leqq H_P < H$ in the scope of the present invention relative to the depth H of molten pig iron in the hot-metal runner, carbon was dissolved into molten pig iron flowing through the hot-metal runner at a high efficiency, and damage to the refractory at the bottom of the hot-metal runner caused by blowing of the granular chemical composition adjusting agents was inhibited to a level almost negligible. In Comparison Cases 13 to 15 in which the penetration depth $H_P$ was within the range of $H_P>H$, in contrast, carbon was dissolved into molten pig iron at a high efficiency, but there was a serious damage to the refractory at the bottom of the hot-metal runner.

According to the present invention, as described above in detail, it is possible to adjust the chemical composition of molten pig iron flowing through a hot-metal runner of a blast furnace at a stable and high efficiency without the risk of damage to the bottom of the hot-metal runner caused by blowing of the granular chemical composition adjusting agent, thus providing industrially useful effects.

What is claimed is:

1. In a method for adjusting the chemical composition of molten pig iron tapped from a blast furnace, which comprises:

substantially vertically arranging at least one lance above a hot-metal runner for directing molten pig iron tapped from a blast furnace into a hot-metal ladle so that the lowermost end of said at least one lance is spaced apart by a prescribed distance from the surface of molten pig iron flowing through said hot-metal runner, and blowing, through said at least one lance, a granular chemical composition adjusting agent by means of a carrier gas into molten pig iron flowing through said hot-metal runner to adjust the chemical composition of said molten pig iron;

the improvement wherein:

said blowing of said granular chemical composition adjusting agent through said at least one lance into said molten pig iron is carried out so as to satisfy the following two equations:

$$0.5H \leqq H_P < H \quad (1)$$

$$H_P = M \cdot G \cdot exp(-\bar{r})/(D+0.02H_L)^2 \quad (2)$$

in equations (1) and (2),

H: depth of molten pig iron in the hot-metal runner (mm), $H_P$: penetration depth of the granular chemical composition adjusting agent into molten pig iron in the hot-metal runner (mm), M: flow rate of the granular chemical composition adjusting agent (kg/minute), G: flow rate of the carrier gas ($Nm^3$/minute), $\bar{r}$: average particle size of the granular chemical composition adjusting agent (mm), D: inside diameter of the lance (mm), and $H_L$: distance between the surface of molten pig iron in the hot-metal runner and the lowermost end of the lance (mm).

2. The method as claimed in claim 1, wherein said blowing step comprises: blowing, through said at least one lance, a granular chemical composition adjusting agent for removing at least one of silicon, phosphorus and sulfur as impurities contained in molten pig iron, as said granular chemical composition adjusting agent, into molten pig iron flowing through said hot-metal runner to remove at least one of said silicon, phosphorus and sulfur as impurities contain in said molten pig iron.

3. The method as claimed in claim 2, wherein said blowing step comprises:

blowing said granular chemical composition adjusting agent for removing silicon as one of impurities contained in molten pig iron through said at least one lance into molten pig iron flowing through said hot-metal runner to remove silicon as one of impurities contained in said molten pig iron.

4. The method as claimed in claim 2, by wherein said blowing step comprises:

blowing said granular chemical composition adjusting agent for removing phosphorus as one of impurities contained in molten pig iron through said at least one lance into molten pig iron flowing through said hot-metal runner to remove phosphorus as one of impurities contained in said molten pig iron.

5. The method as claimed in claim 2, wherein said blowing step comprises:

blowing said granular chemical composition adjusting agent for removing sulfur as one of impurities contained in molten pig iron through said at least one lance into molten pig iron flowing through said hot-metal runner to remove sulfur as one of impurities contained in said molten pig iron.

6. The method as claimed in claim 2, comprising:

using a first lance and a second lance as said at least one lance; and wherein said blowing step comprises:

blowing said granular chemical composition adjusting agent for removing silicon as one of impurities contained in molten pig iron through said first lance into molten pig iron flowing through said hot-metal runner; and blowing said granular chemical composition adjusting agent for removing phosphorus as one of impurities contained in molten pig iron through said second lance arranged downstream of said first lance relative to the flowing direction of molten pig iron in said hot-metal runner, into molten pig iron flowing through said hot-metal runner;

thereby removing silicon and phosphorus as impurities contained in said molten pig iron.

7. The method as claimed in claim 2, comprising:

using a first lance and a second lance as said at least one lance; and wherein said blowing step comprises:

blowing said granular chemical composition adjusting agent for removing sulfur as one of impurities contained in molten pig iron through said first lance into molten pig iron flowing through said hot-metal runner; and blowing said granular chemical composition adjusting agent for removing silicon as one of impurities contained in molten pig iron through said second lance arranged downstream of said first lance relative to the flowing direction of molten pig iron in said hot-metal runner, into molten pig iron flowing through said hot-metal runner;

thereby removing sulfur and silicon as impurities contained in said molten pig iron.

8. The method as claimed in claim 2, wherein said blowing step comprises:

blowing said granular chemical composition adjusting agent for removing phosphorus and sulfur as impurities contained in molten pig iron through said at least one lance into molten pig iron flowing through said hot-metal runner to remove phosphorus and sulfur as impurities contained in said molten pig iron.

9. The method as claimed in claim 2, comprising:

using a first lance, a second lance and a third lance as said at least one lance; and wherein said blowing step comprises:

blowing said granular chemical composition adjusting agent for removing silicon as one of impurities contained in molten pig iron through said first lance into molten pig iron flowing through said hot-metal runner;

blowing said granular chemical compostion adjusting agent for removing phosphorus as one of impurities contained in molten pig iron through said second lance arranged downstream of said first lance relative to the flowing direction of molten pig iron in said hot-metal runner, into molten pig iron flowing through said hot-metal runner; and blowing said granular chemical composition adjusting agent for removing sulfur as one of impurities contained in molten pig iron through said third lance arranged downstream of said second lance relative to the flowing direction of molten pig iron in said hot-metal runner, into molten pig iron flowing through said hot-metal runner;

thereby removing silicon, phosphorus and sulfur as impurities contained in said molten pig iron.

10. The method as claimed in claim 2, comprising:

using a first lance, a second lance and a third lance as said at least one lance; and wherein said blowing step comprises:

blowing said granular chemical composition adjusting agent for removing sulfur as one of impurities contained in molten pig iron through said first lance into molten pig iron flowing through said hot-metal runner;

blowing said granular chemical composition adjusting agent for removing silicon as one of impurites contained in molten pig iron through said second lance arranged downstream of said first lance relative to the flowing direction of molten pig iron in said hot-metal runner, into molten pig iron flowing through said hot-metal runner; and blowing said granular chemical composition adjusting agent for removing phosphorus as one of impurities contained in molten pig iron through said third lance arranged downstream of said second lance relative to the flowing direction of molten pig rion in said hot-metal runner, into molten pig iron flowing through said hot-metal runner;

thereby removing sulfur, silicon and phosphorus as impurities contained in said molten pig iron.

11. The method as claimed in claim 2, comprising:

using a first lance and a second lance as said at least one lance; and wherein said blowing step comprises:

blowing said granular chemical composition adjusting agent for removing silicon as one of impurities contained in molten pig iron through said first lance into molten pig iron flowing through said hot-metal runner; and blowing said granular chemical composition adjusting agent for removing phosphorus and sulfur as impurities contained in molten pig iron through said second lance arranged downstream of said first lance relative to the flowing direction of molten pig iron in said hot-metal runner, into molten pig iron flowing through said hot-metal runner;

thereby removing silicon, phosphorus and sulfur as impurities contained in said molten pig iron.

12. The method as claimed in claim 1, wherein said blowing step comprises:

blowing, through at least one lance, a granular chemical composition adjusting agent for further increasing the carbon content in molten pig iron, as said granular chemical composition adjusting agent, into molten pig iron flowing through said hot-metal runner to increase the carbon content in said molten pig iron.

* * * * *